US011407081B2

(12) United States Patent
Joo et al.

(10) Patent No.: US 11,407,081 B2
(45) Date of Patent: Aug. 9, 2022

(54) SUBSTRATE PROCESSING APPARATUS

(71) Applicant: KCTECH CO., LTD., Anseong-si (KR)

(72) Inventors: Jong-Tae Joo, Hwaseong-si (KR); Sang Hyun Kim, Hwaseong-si (KR); Ho Cheon Jeong, Hwaseong-si (KR); Jae Yeol Kim, Hwaseong-si (KR)

(73) Assignee: KCTECH CO., LTD., Anseong-si (KR)

( * ) Notice: Subject to any disclaimer, the term of this patent is extended or adjusted under 35 U.S.C. 154(b) by 617 days.

(21) Appl. No.: 16/416,736

(22) Filed: May 20, 2019

(65) Prior Publication Data

US 2020/0009703 A1 Jan. 9, 2020

(30) Foreign Application Priority Data

Jul. 3, 2018 (KR) ..... 10-2018-0076800

(51) Int. Cl.
*B24B 37/005* (2012.01)
*B24B 37/30* (2012.01)

(52) U.S. Cl.
CPC ..... *B24B 37/005* (2013.01); *B24B 37/30* (2013.01)

(58) Field of Classification Search
CPC ..... B24B 37/005; B24B 37/30; B24B 37/10; B24B 37/20; B24B 37/34; B24B 37/345; B24B 51/00; B24B 49/00; B24B 57/02; H01L 21/304; H01L 21/30625
USPC ..... 451/5
See application file for complete search history.

(56) References Cited

U.S. PATENT DOCUMENTS 5,908,347 A * 6/1999 Nakajima ..... B24B 37/345 451/5
6,264,533 B1 * 7/2001 Kummeth ..... B24D 11/00 451/8
7,037,172 B1 * 5/2006 Molnar ..... B24B 49/00 451/5
2008/0081540 A1 * 4/2008 Sato ..... H01L 21/67219 451/28
2018/0158707 A1 * 6/2018 Hunter ..... G05B 19/0425

FOREIGN PATENT DOCUMENTS

CN 108389794 A * 8/2018

OTHER PUBLICATIONS

English Translation of CN 108389794 (Year: 2018).*

* cited by examiner

*Primary Examiner* — Joseph J Hail
*Assistant Examiner* — Timothy Brady
(74) *Attorney, Agent, or Firm* — Stein IP, LLC

(57) ABSTRACT

The present invention relates to a substrate polishing system comprising a polishing pad covered on the polishing platen; a plurality of substrate carriers including a first substrate carrier which moves in a state in which a substrate is mounted and performs a polishing process in a state in which the substrate is in contact with the polishing pad on the polishing pad; a monitoring unit of displaying the information including the identity, position of at least one of the substrate carriers; and a control unit of outputting a warning signal and/or changes the operation of operating devices when an error occurs in real time thereby improving the monitoring efficiency and operation reliability of the polishing process of the substrate.

21 Claims, 11 Drawing Sheets

C : C1, C2, C3, C4, C5

SUBSTRATE PROCESSING APPARATUS

CROSS-REFERENCE TO RELATED APPLICATIONS

This U.S. non-provisional patent application claims priority under 35 U.S.C. § 119 of Korean Patent Application Nos. 10-2018-076800 filed on Jul. 3, 2018, the entire contents of which are hereby incorporated by reference.

BACKGROUND OF THE INVENTION

The present invention disclosed herein relates to a substrate polishing system, and more particularly to a substrate polishing system capable of more accurately detecting errors and systematically performing to monitor substrate carriers which moves independently with mounting a substrate.

As semiconductor devices are fabricated with high density integration of fine circuit lines, polishing is performed precisely on the wafer surface. In order to perform polishing of the wafer more precisely, a chemical mechanical polishing process (CMP process) with both mechanical polishing and chemical polishing is performed.

In recent years, a single substrate is sequentially carried out in a plurality of polishing platens for more precise polishing processes. In order to more efficiently perform the multistage polishing processes, a polishing head is moved to a plurality of polishing platens with a substrate mounted thereon, and multistage polishing processes are carried out in a plurality of polishing platens.

As the polishing process of the substrate becomes more sophisticated, multistage polishing processes are required in more polishing platens and the substrate carrier which includes a polishing head mounting a substrate respectively may move independently. However, when the substrate carriers perform each polishing process and move independently, there arise problems that it is very complicated to correctly recognize the status of the substrate carrier and to detect errors of the polishing process or errors of the substrate carrier.

Accordingly, there is a high demand for improving the reliability of the substrate processing process by monitoring the positions, paths, and errors of a large number of substrate carriers in real time during the substrate processing process.

SUMMARY OF THE INVENTION

The present invention has been made in view of the technical background described above and it is an object of the present invention to provide a substrate polishing system to more accurately monitor the position and status of a substrate carrier for carrying out a polishing process while moving with mounting a substrate.

It is another object of the present invention to monitor an operation status of a substrate carrier by tracking a movement path, a position, and an operating state of each substrate carrier which move independently along a predetermined path with mounting the substrate thereby observing more accurately the state of the substrate carrier and detecting errors of the substrate carrier.

Accordingly, it is an object of the present invention to improve stability and reliability of a substrate polishing process as well as process efficiency.

In order to achieve the above object, the present invention provides a substrate polishing system to monitor paths, positions and operation statuses of substrate carriers by the substrate carrier, during all the necessary processes for polishing the substrate, whereby the efficiency of the monitoring the polishing processes is improved and the substrate carrier detected as having error is accurately identified and maintained efficiently.

The phrase of "polishing unit" described in the present specification and claims is defined to not only include a polishing pad, a polishing head, and a slurry supplier for directly being involved in a polishing process of a substrate, but also includes a docking device, a loading device, substrate carrier, and the like for preparing or finishing the polishing process.

The terms of "monitoring" and similar terms used in this specification and claims are defined as both monitoring the position, path, operating state, etc., of the substrate carrier of the polishing unit, and collecting measured or sensed value(s) for monitoring.

As described above, according to the present invention, it is possible to obtain an effect of automatically detecting an error by monitoring the positions, paths, and operating states of a plurality of substrate carriers used in the polishing process of the substrate in real time.

In addition, according to the present invention, a plurality of substrate carriers performing the polishing process move independently in the polishing process, and the plurality of substrate carriers are tracked and monitored in view of each substrate carrier, whereby the state, position, and error of the substrate carriers in the polishing process can be systematically managed.

According to the present invention, errors of the substrate carrier in the polishing process are classified and stored in a memory or displayed by each substrate carrier, so that the operator can accurately and easily notice the errors and the operating state by the substrate carrier at a glance, and it is possible after the polishing process to check the errors and the operating state afterwards by tracking the substrate carrier in the stored data.

In addition, the present invention can improve the reliability of the polishing process of the substrate by correcting errors of the substrate carrier generated in the polishing process in real time.

The present invention also provides a method of correcting various types of errors in a substrate carrier by classifying fatal error information that must immediately stop the polishing process, a first warning error information that can correct errors in real time without immediately stopping, and a second warning error information that is enough to transmit a warning signal S2 without stopping the polishing process, thereby minimizing the inhibition of the polishing process depending on the type of errors, correcting the detected errors, improving the quality of the substrate polishing, and increasing the process efficiency.

Thus, the present invention can improve the stability and reliability of the substrate processing process and improve the process efficiency.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
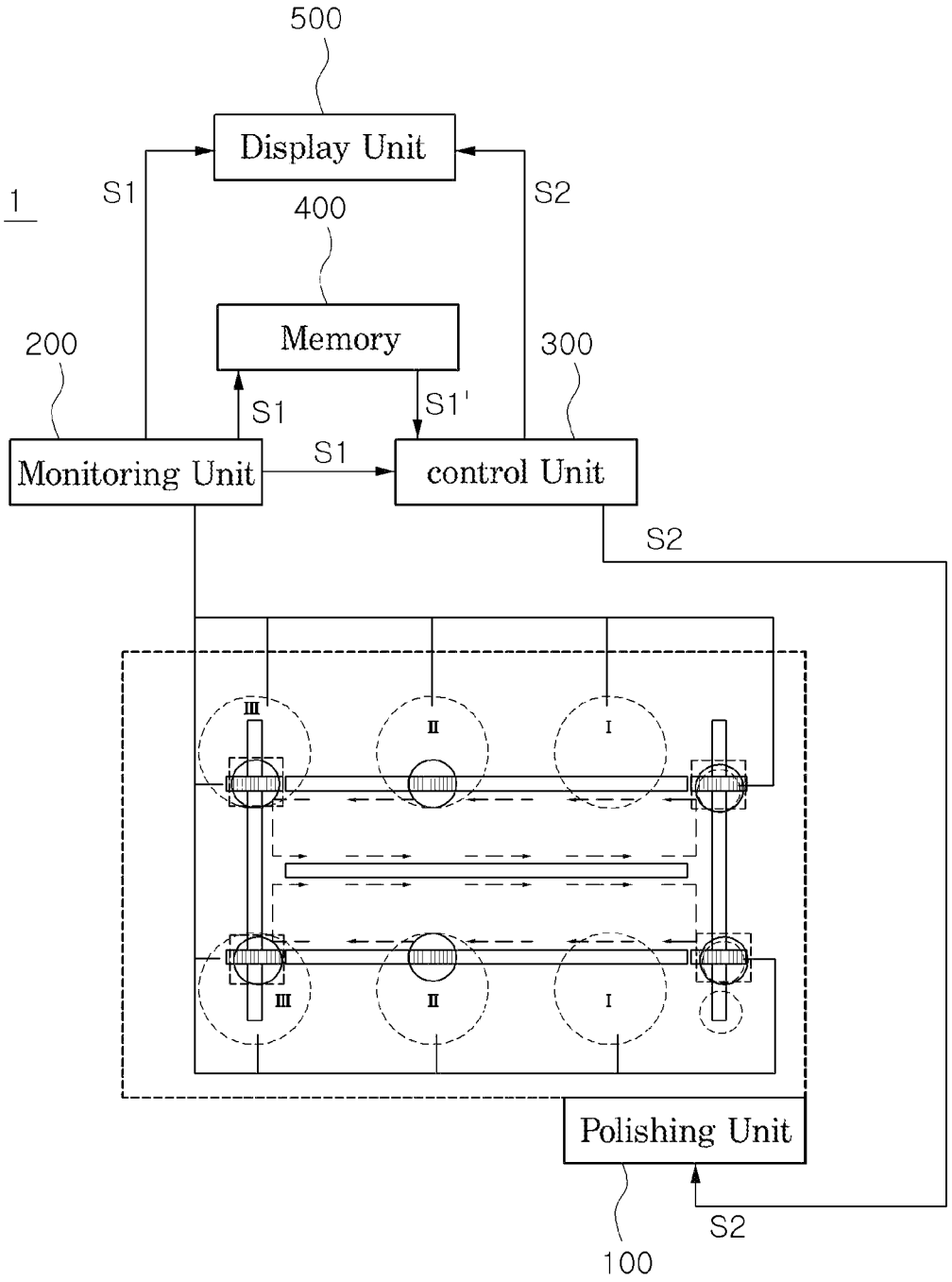
FIG. 1 is a schematic view showing a configuration of a substrate polishing system according to an embodiment of the present invention.
Figure 2:
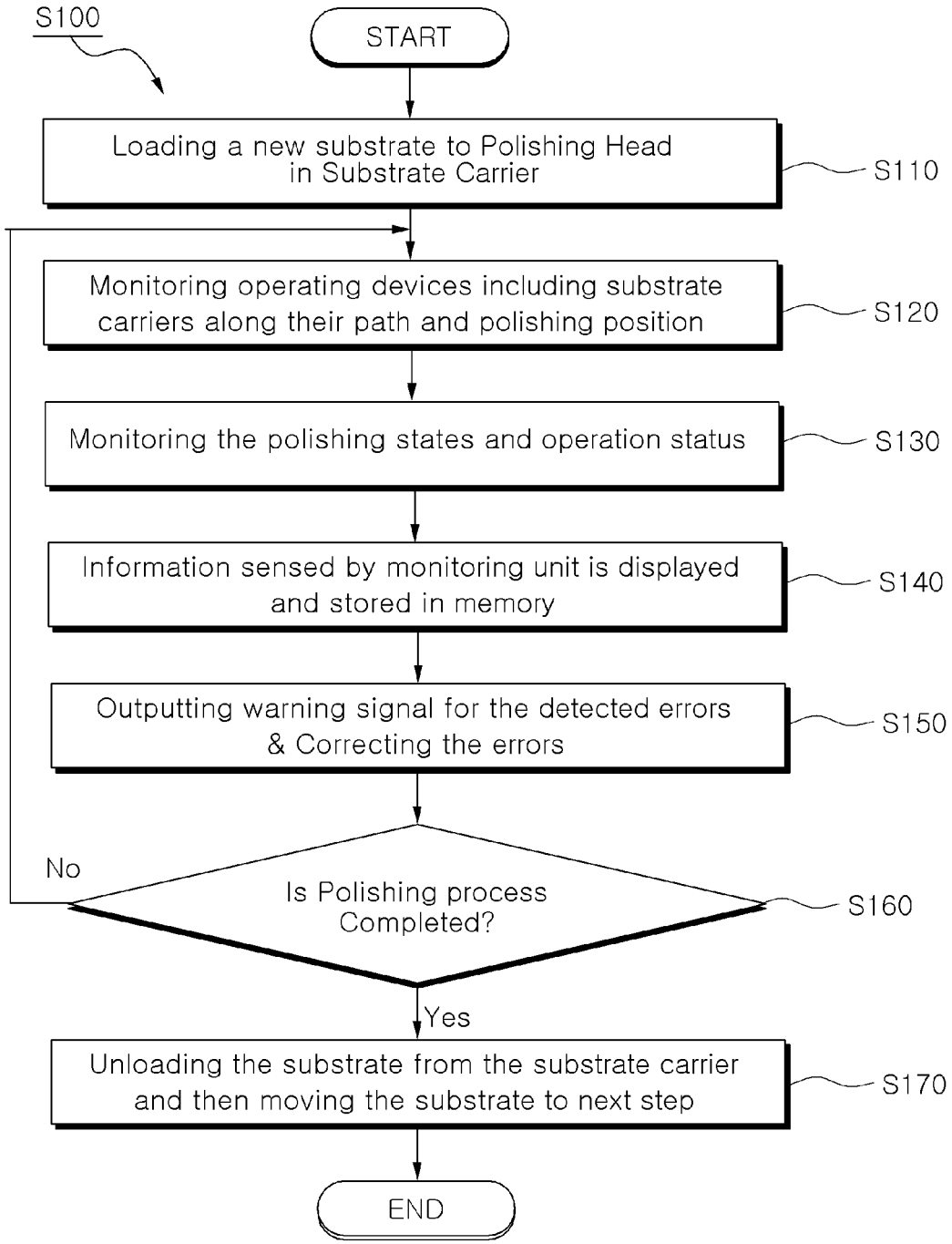
FIG. 2 is a flow chart sequentially showing the monitoring method of the substrate polishing system of FIG. 1.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

As shown in FIGS. 1 to 10, a substrate polishing system 1 in accordance with the present invention comprises a polishing unit 100, a monitoring unit 200, a control unit 300, memory 400 and display unit 500. Herein, the monitoring unit 200 monitors the position and operating state of the substrate carrier 120C which moves with mounting the substrate and rotate the substrate with pressure in the polishing process. The control unit 300 receives the monitoring signal S1 of the monitoring unit 200, detects the position and operation error for each substrate carrier 120C and stop or compensate the operation of at least one polishing unit 100, if necessary. The reference data on both the normal operating positions and normal operating states has been stored in the memory 400 and the monitoring signal S1 received during the polishing process from the monitoring unit 200 is also stored in the memory 400. The display unit 500 displays the positions and states of the substrate carrier 120C monitored by the monitoring unit 200.

The polishing unit 100 receives a substrate, polishes the substrate and then transfers the substrate to the next process. The polishing unit 100 may be constructed that a substrate is polished in one polishing platen, or that a substrate is sequentially polished in plural polishing platens as shown in FIG. 1 and FIG. 3.

The polishing unit 100 has lots of operating devices for realizing the above operation. Concretely, as shown in FIG. 1 and FIG. 3, the polishing unit 100 includes a loading device 160 for supplying a substrate W to the substrate carrier 120C, at least one substrate carrier 120C which moves with the substrate mounted by the loading device 160 along a predetermined path 120*d* and rotates and press the substrate for the polishing process at the predetermined first position X1 on the polishing pad 111, guide rails 131, 132, 133, 134 distributed to guide the substrate carrier 120C along the part of the predetermined path 120*d*, a docking device 140 of docking with the substrate carrier 120C for supplying at least one of air pressure, electric power, rotational torque, etc. when the substrate carrier arrives at the predetermined first position X1, and unloading device 170 of unloading the polished substrate W from the substrate carrier 120C and transferring to the next cleaning process.

The substrate carrier 120C moves independently from one another along the predetermined path 120*d* of the polishing unit 100. The substrate carriers 120C may be plural including a first substrate carrier WC1 which moves with mounting a first substrate and lets the first substrate contacted with the polishing pad 111 and then polished, and a second substrate carrier WC2 which moves with mounting a second substrate and lets the second substrate contacted with the polishing pad 111 and the polished.

Figure 3:
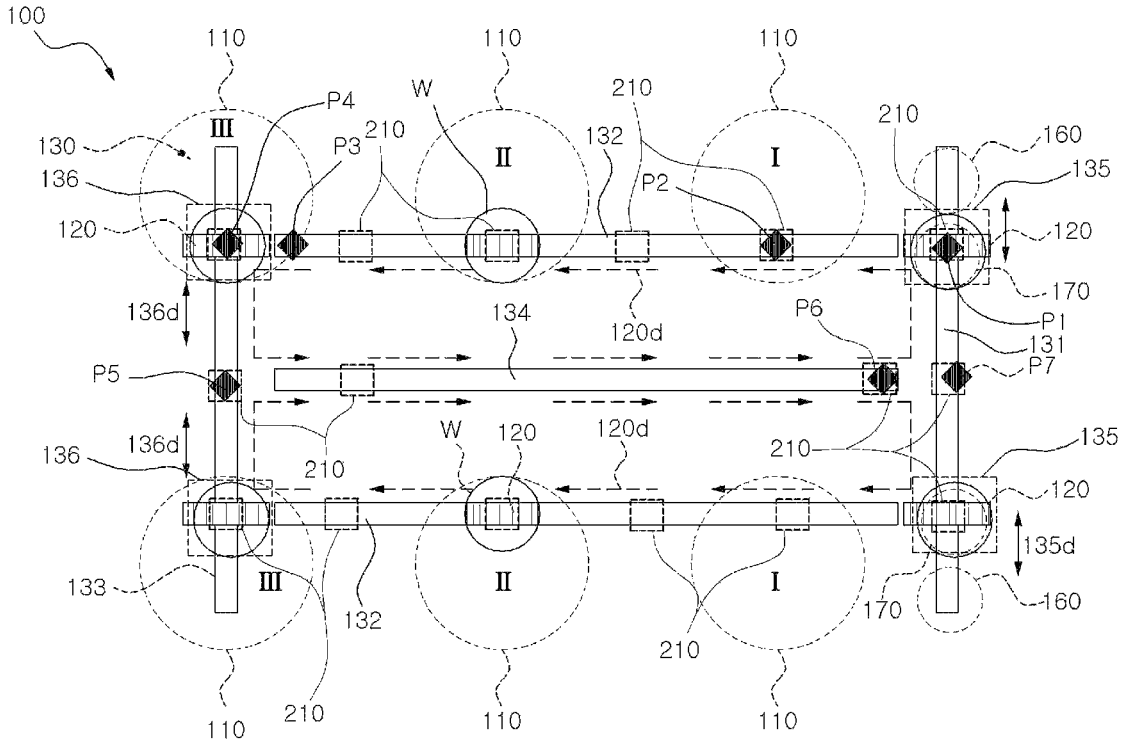
FIG. 3 is a plan view showing the configuration of the polishing unit of FIG. 1.

Although six substrate carriers are exemplified in FIG. 3, the more or the less number of substrate carriers may be included in the polishing unit, and the substrates mounted in the substrate carriers are moved with the substrate carriers and then polished. Preferably, the number of the substrate carriers is greater than the number of the polishing platens of the polishing unit 100. Herein, the substrate mounted in a substrate carrier 120C may be polished on only one polishing pad 111, or may be polished sequentially on more than two polishing pads.

The monitoring unit 200 includes a carrier sensing part 210 which identifies each of substrate carriers 120C by recognizing the identifiers 120*x* formed on the substrate carriers 120C (i.e., it means the recognition of the identity of each of the substrate carriers) and monitors the information such as position of the substrate carrier 120C. For this, the carrier sensing part 210 is distributed on or near the movement path 120*d* of the substrate carrier 120C, especially at or near the polishing pad 111.

Herein, the identifier 120*x* may be formed as barcode or diverse shape of protrusions or one of conventional shapes.

Thus the monitoring unit 200 is capable of tracking the position and movement path for each of the substrate carriers 120C in real time. The information including position, identification, etc. monitored by the monitoring unit 200 is transmitted to the control unit 300, the memory 400 and display unit 500 as a form of monitoring signal S1. The display unit 500 displays the information by substrate carriers 120C based on the monitoring signal S1.

As described later, the monitoring unit 200 monitors the operation states of many operating devices of the polishing unit 100 as well as the positions and path of the substrate carriers 120C, and transmits to the control unit 300 and memory 400 the monitoring signal S1 which includes the information on the operation states of the operating devices, whereby the control unit 300 is capable of detecting or discriminating the error of the operation states for each operating device.

That is, the substrate carriers 120C used in the polishing unit 100 are provided with an identifier 120*x* and the monitoring unit 200 is capable of identifying the substrate carrier by the identifier 120*x*, whereby it is possible to track which substrate carriers 120C is on the movement path 120*d* and on which path the substrate carrier 120C is moving over time. Particularly, the carrier sensing part 210 of the monitoring unit 200 senses the identifiers 120*x* on the polishing pad 111 on which the polishing process is performed, thereby determining which substrate carrier among the substrate carriers 120C is put into the polishing process so that the polishing process can be tracked for each substrate carrier.

Hereinafter, an operation principle and a configuration according to the sequence of the polishing process of the substrate in the polishing unit 100 will be described.

First, when a substrate W requiring a polishing process is supplied to the polishing unit 100, the substrate W is placed on the mounting table of the loading device 160. When the substrate carrier 120C is located on the upper side of the loading device 160, the substrate W is loaded to the polishing head 120 of the substrate carrier 120C from the loading device 160 so that the substrate W is mounted on the substrate carrier 120C. Here, the information of the substrate W mounted on the substrate carrier 120C is transmitted to the control unit 300 before being supplied to the loading device 160, and as described later, the identifier 120*x* of the substrate carrier 120C is monitored in real time, and thus it is monitored in real time whether a certain substrate W is loaded on which substrate carrier 120C and the polishing process is performed.

Although not shown in the drawings, the monitoring unit 200 may be disposed at or near the loading device 160 to monitor the substrate carrier 120C via an identifier 120*x* of the substrate carrier 120C so as to identify which substrate carrier receives the substrate W from the loading device 160. And the monitoring unit 200 transmits to the control unit 300, memory 400 and display unit 500 the monitoring signal S1 with the information on whether the substrate W is normally mounted on the identified substrate carrier 120C. Here, the monitoring signal S1 regarding whether the substrate W is normally mounted on the substrate carrier 120C may be more than one of an image photographed from the lower side of the polishing head 120 and a light signal received from the polishing head 120 after irradiating the source light.

The control unit 300 that has received the monitoring signal S1 determines whether the substrate W is normally mounted on the substrate carrier 120C or not. If the substrate W is determined not to normally mounted on the substrate carrier 120C, the control unit 300 stops transferring the substrate carrier 120C to the polishing platen 110 and outputs a warning signal. Here, the warning signal may be variously displayed in the form of outputting a warning message to the display unit 500, outputting a warning alarm, or outputting an alarm signal to the mobile device of the operator.

Then, the memory 400 receives the monitoring signal S1 and stores the received monitoring signal S1 for each identified substrate carrier 120C. This allows the operator to track the operational state of the particular substrate carrier 120C identified by the identifier 120*x* as needed during the polishing process or after the polishing process is terminated. The data stored in the memory 400 can be utilized as basic data for identifying the cause of the error of the substrate carrier. To this end, the memory 400 preferably stores the monitoring data obtained by the monitoring unit for each substrate carrier.

The display unit 500 receives the monitoring signal S1 and displays the status, operation states, and position information of the substrate carrier 120C on which the substrate W is mounted by the loading device 160.

The polishing head 120 is coupled to the lower connection portion 120*z* of the substrate carrier 120C and moves with the substrate carrier 120C. The polishing head 120 functions to polish the substrate by pressing the substrate W downward against the polishing pad 111 while receiving rotational driving force and air pressure from the substrate carrier 120C and by rotating the substrate 120*r* during the polishing process.

Figure 8:
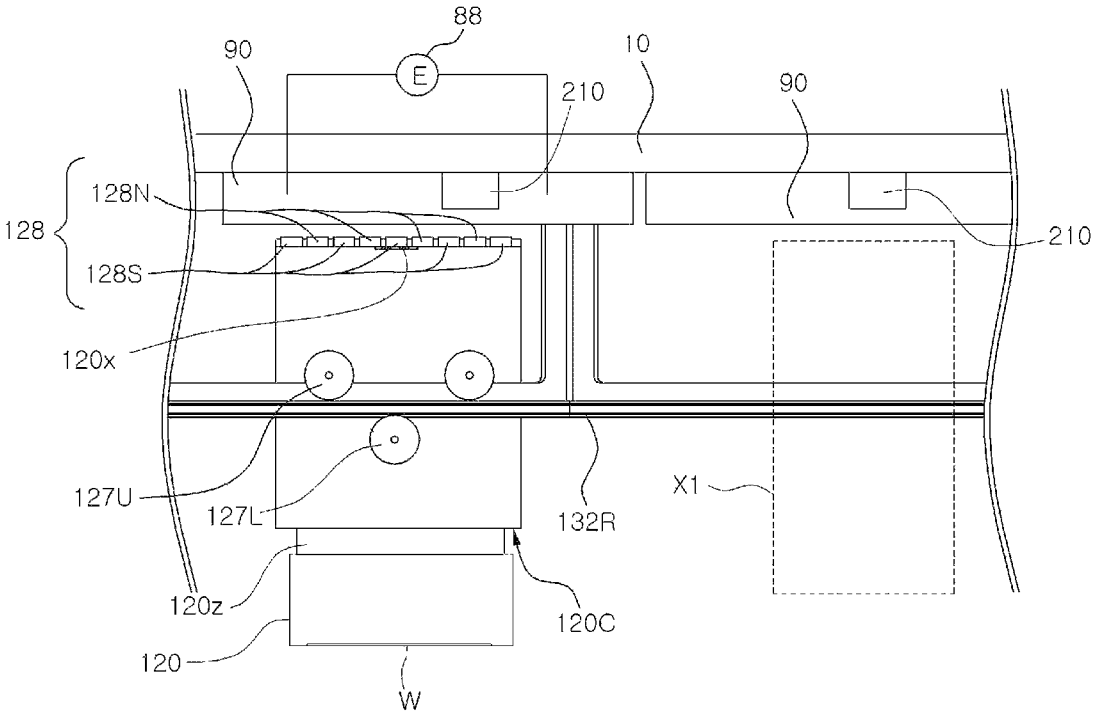
FIG. 8 is a schematic view taken along the line A-A in FIG. 7 for explaining the principle of movement of the substrate carrier.
Figure 9:
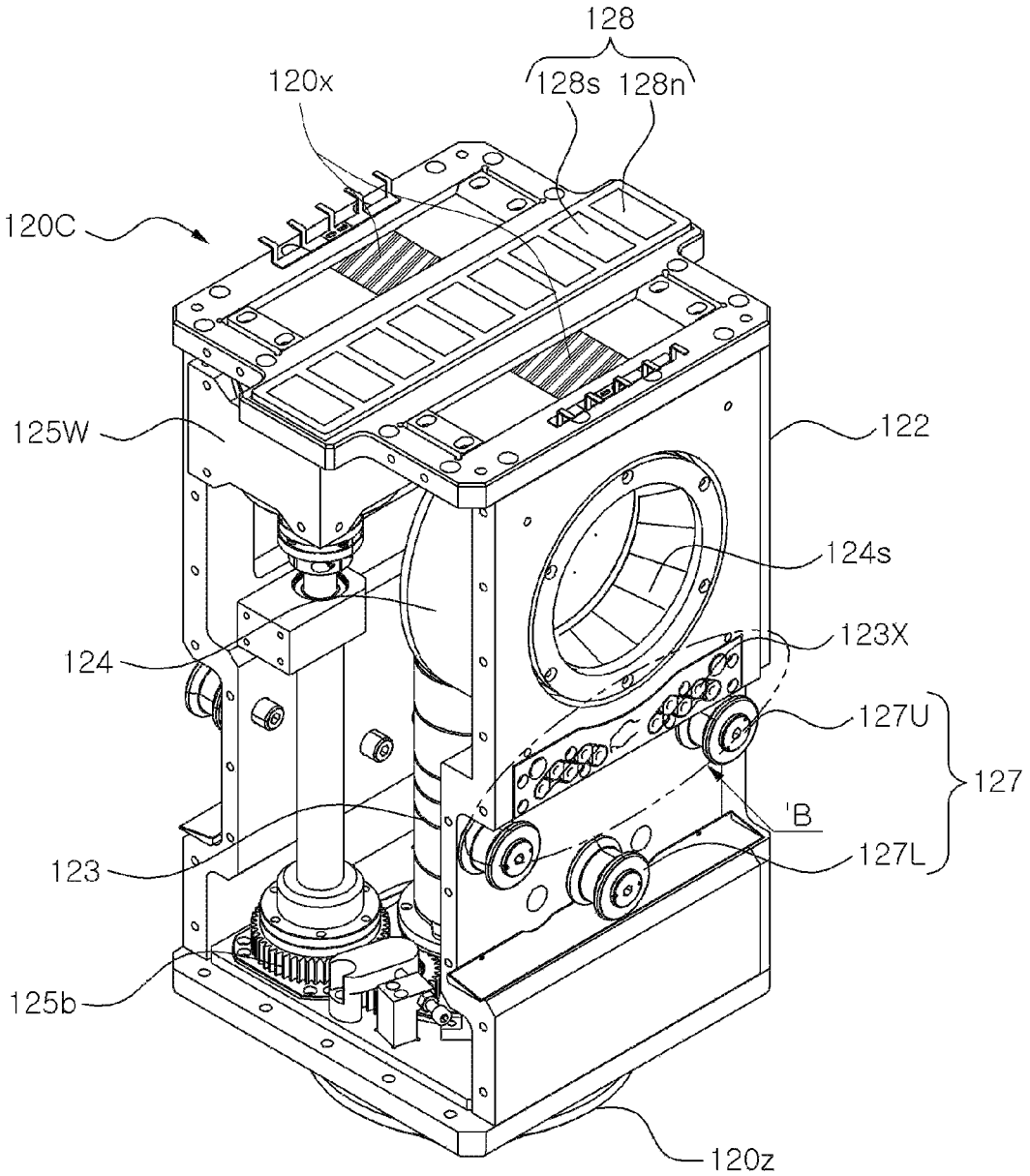
FIG. 9 is a perspective view showing an example configuration of a substrate carrier applicable to FIG. 6.

The substrate carrier 120C moves along the guide rails 132R, 134R, and 135R arranged along a predetermined path. Here, a driving device for moving may be provided on the substrate carrier 120C. However, according to the preferred embodiment of the present invention, as shown in FIGS. 8 and 9, A permanent magnet 128 having an N pole magnet 128*n* and an S pole magnet 128*s* is alternately arranged on a surface of the substrate carrier 120C, and coils 90 are disposed to face the permanent magnet 128 along the guide rail 132R. Accordingly, the substrate carrier 120C can be configured to move by the current applied to the coils 90 from the external power source 88. That is, electric power is not supplied to the substrate carrier 120C for moving but supplied to the coils 90 outside of the substrate carrier 120C, so that the substrate carrier 120C can be freely moved because electric wire is not connected to the substrate carrier 120C. Therefore, the present invention can obtain the effect that the substrate carriers 120C can move independently with one another in accordance with the current applied from the polishing unit 100.

A carrier sensing part 210 is installed as a monitoring unit 200 at a plurality of positions arranged along the movement path of the substrate carrier 1200. An identifier 120*x* is formed on the plurality of substrate carriers 120C respectively so that each substrate carrier 120C can be identified. According to one embodiment of the present invention, the identifier 120*x* may be disposed on the top surface of the substrate carrier 120C.

Accordingly, even if the substrate carriers 120C move independently with one another along the movement path 120*d* by current control applied to the coils 90, the carrier sensing part 210 arranged in plural along the movement path monitors the information such as movement path 120*d* and positions for each substrate carrier 120C (S120). A monitoring signal, such as the position, the movement path, etc. of the substrate carrier 120C is transmitted to the control unit 300 and display unit 500 displays the position of the substrate carriers in real time. In addition, it is possible to monitor the operation state of each of the substrate carriers 120C recognized via the identifier 120*x* and to maintain the system carrier 120C systematically.

Reference numeral 10 in the drawings denotes a frame in which the guide rails, the coils 90, and the like are fixedly installed. Reference numerals 127L and 127U denote guide rollers for guiding the substrate carrier 120C to move along the guide rail 132R.

Meanwhile, as shown in FIGS. 1 and 3, the guide rails 132, 134 are arranged parallel to each other, and the guide rails 131, 133 connecting the guide rails 132, 134 are vertically arranged. Accordingly. Carrier shuttles 135, 136 are provided with the guide rails 131, 133 so that the carrier shuttle 135, 136 receive the substrate carrier 120C respectively and move with the substrate carrier 120C. That is, the substrate carrier 120C moving along the guide rails 132 and 134 moves from the positions P3, P6 of the guide rails to the carrier shuttles 135, 136 at the positions P4, P7, and the carrier carriers 135, 136 move along the guide rails 132, 134 so that the substrate carrier 120C moves in the arrangement direction of the guide rails 132, 134 as numerals of 135*d*, 136*d*. And then the substrate carrier 120C moves to the positions (for example, P2) of the guide rails 132, 134 from the positions of P1, P5.

Such a configuration is disclosed in Korean Patent Registration Nos. 10-0921655 and 10-1130888 filed by the applicant of the present invention, and the configuration disclosed in Korean Patent Registration Nos. 10-0921655 and 10-1130888 are incorporated herein by reference.

The figures show a configuration in which the polishing process is performed on the polishing platen I, II, III while the polishing head 120 is fixed to the substrate carrier 120C. However, the present invention is not limited thereto, and includes the configuration of the polishing unit of various forms and configurations in which the polishing process of the substrate is carried out.

Figure 6:
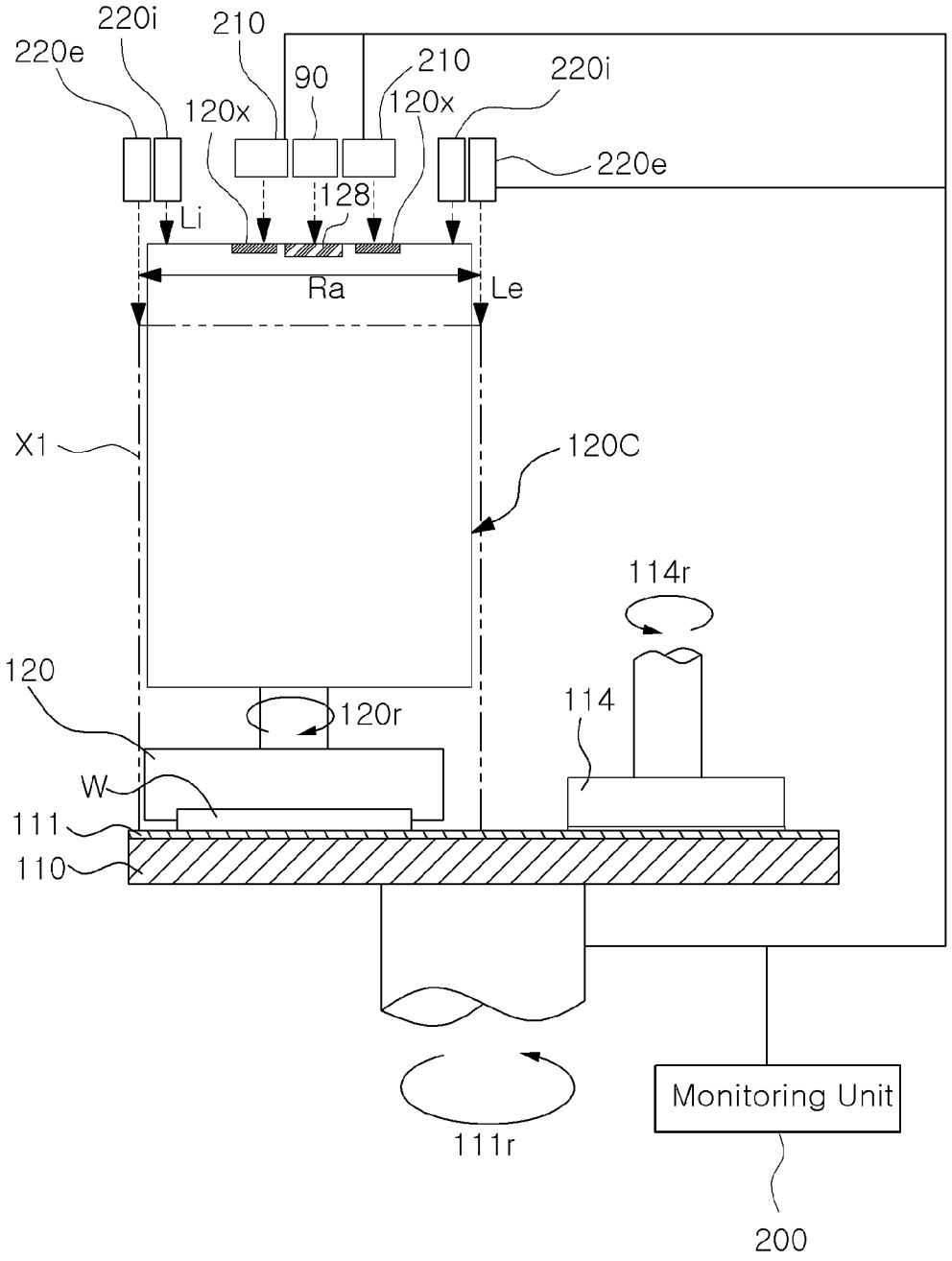
FIG. 6 is a side view showing the configuration for monitoring the position of a substrate carrier on the polishing pad in FIG. 4.
Figure 7:
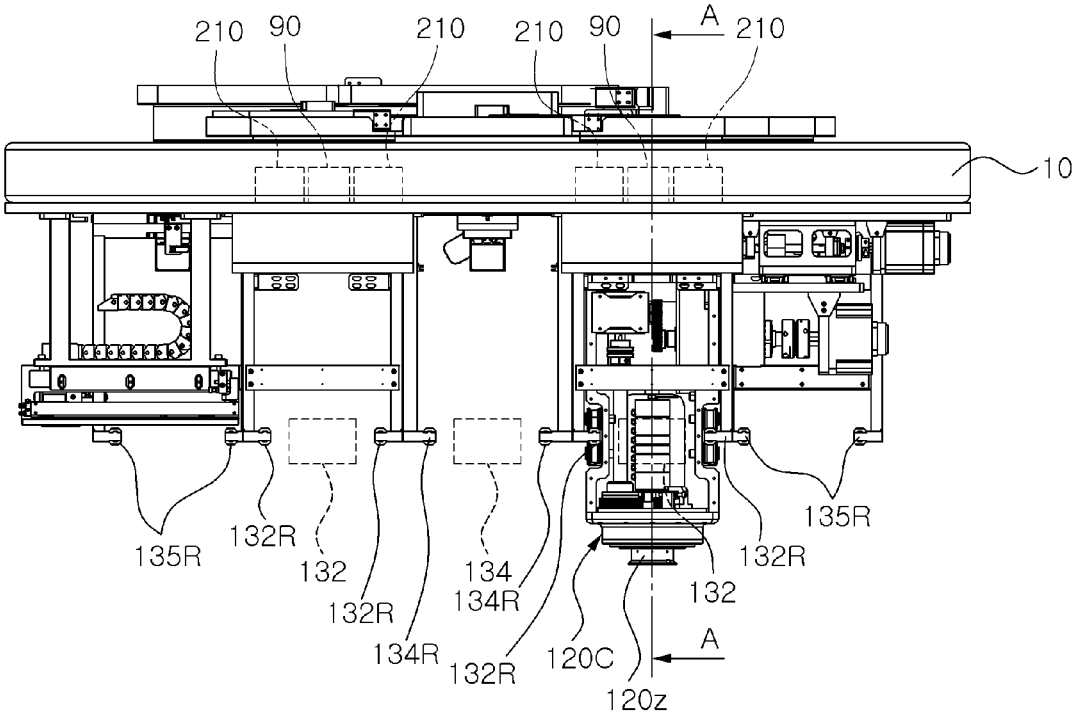
FIG. 7 is a cross-sectional view showing a configuration in which the substrate carrier of FIG. 6 moves along the guide rail.

On the other hand, as shown in FIG. 6, the carrier sensing part 210 is also provided at a first position X1 on the polishing table 110 to monitor whether the substrate carriers 120C moving independently along the predetermined path is performing a polishing process on the polishing table.

Concretely, when a substrate carrier 120 is located on any one of the polishing platens I, II, III for polishing process, the carrier sensing part 210 senses the identifier 120*x* to determine which substrate carrier 120C is positioned on the polishing platen 110. Simultaneously, the monitoring unit 200 monitors whether the substrate carrier 120C reaches the first predetermined position X1 on the polishing platen 110 by the position sensors 220*i*, 220*e* formed by an optical sensor or the like. The monitoring signal S1 acquired by the monitoring unit 200 is transmitted to the control unit 300.

As described later, when the substrate carrier 120C moves along the guide rails 120*d* onto the polishing platen 110 to reach the first predetermined position X1 as shown in FIG. 6, the carrier sensing part 210 senses which substrate carrier has reached the first position X1. the polishing quality of the substrate W can be stably secured. In order that the polishing quality of the substrate W can be stably secured, the substrate W should be accurately positioned at the predetermined first position X1 of the polishing pad 111. Thus the position sensors 220*i* and 220*e* of the monitoring unit 200 monitor whether the substrate carrier 120C is accurately positioned within the allowable range at the first position X1 on the polishing pad 111 where the polishing process is performed. When it is detected as a monitoring signal out of the allowable range from the first position X1, the polishing process is stopped or a warning signal is output.

Then the polishing table 100 is moved upward or the polishing head 120 moves downward so that the substrate W mounted on the bottom surface of the polishing head 120 comes to contact with the polishing pad 111 and the polishing process is performed for the substrate W.

Here, identifiers 120*x* are disposed on both sides of the upper surface respectively in the substrate carrier 120C, and the carrier sensing part 210 is disposed at two positions spaced apart from the identifier 120*x*. Thus even if an error occurs in the identification of the identifier 120*x* by any of the carrier sensing part 210, the carrier sensing part 210 can identify the substrate carrier 120C accurately. According to another embodiment of the present invention, the identifier 120*x* of the substrate carrier 120C may be formed only in one, and the carrier sensing part 210 may be formed in only one.

Here, the allowable range of the first position X1 is determined such that, the upper surface of the substrate carrier 120C is detected by the irradiation light Li of the inner position sensor 220*i* of the monitoring unit 200, whereas the upper surface of the substrate carrier 120C is not detected by the irradiation light Le of the outer position sensor 220*e*. In this way, by ensuring that the polishing process is performed for each substrate carrier 120C at a predetermined position on the polishing pad 111 by the monitoring unit 200, the polishing amount per unit time can be kept constant to reliably ensure excellent polishing quality.

Figure 10:
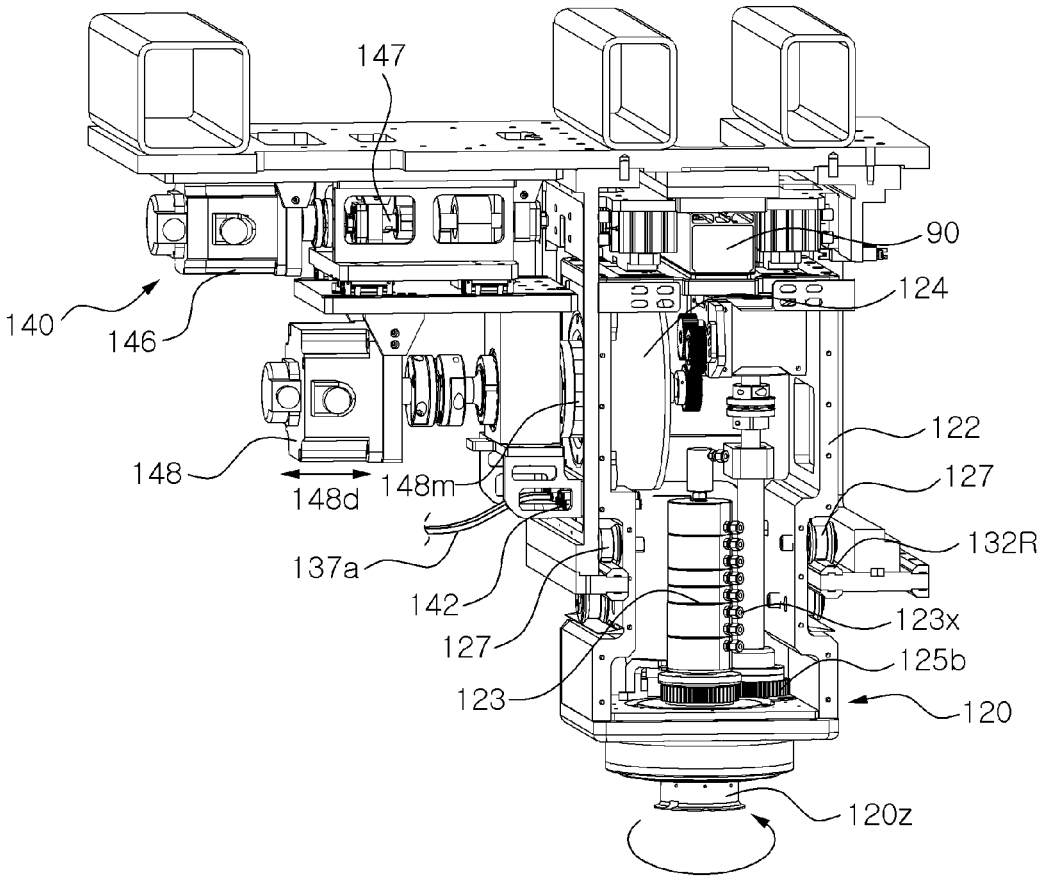
FIG. 10 is a perspective view of a docking device

Then, if it is confirmed based on the monitoring signal S1 by the control unit 300 whether the substrate carrier 120C reaches a predetermined first position X1 of the predetermined polishing platen I, II, III; 110, as shown in FIG. 10, a docking process is performed that the docking device 140 is docked at the substrate carrier 1200. When the docking device 140 is docked to the substrate carrier 120C, at least one of the pneumatic pressure, the electric power and the rotational driving force is supplied to the substrate carrier 120C so that the operation of the polishing head 120 necessary for the polishing process can be performed.

More specifically, as shown in FIG. 9, the substrate carrier 120C is provided with a magnet coupling 124 in which a plurality of N-pole and S-pole permanent magnet straps 124*s* are alternately arranged. When the rotational driving force is transmitted from the docking device 140 through the magnet coupling 124, the magnet coupling 124 rotates and transmits the rotational driving force to the gear box 125W. The rotational driving force is transmitted from the gear box 125W to the vertical rotating shaft in the gear box 125W and polishing head 120 sequentially via the connection gear 125*b* of the vertical rotating shaft.

A rotary union is accommodated in the substrate carrier 120C. A plurality of pneumatic ports 123*x* is formed on the surface of the casing 122 and receives and transfer pneumatic pressure via pneumatic tube to the rotary union.

As shown in FIG. 10, the docking device 140 includes a pneumatic connector 123*a* as a protruded shape which is connected to a pneumatic supply tube 142*a* for supplying pneumatic pressure to a main body 141 opposed to the pneumatic port 123*x* of the substrate carrier 120C. The pneumatic connector 142 is fitted in the pneumatic port 123*x* and supplies pneumatic pressure from the docking device 140 to the substrate carrier 120C.

The docking device 140 rotates the lead screw 147 by the moving motor 146 so that the driving motor 148 moves in axial direction 148*d* of the lead screw and the pneumatic connector 142 are moved to be inserted into the pneumatic port 123*x* of the substrate carrier 120C.

Accordingly, when the rotating shaft rotated by the driving motor 148 is inserted into the magnetic coupling 124 of the substrate carrier 120C, and when the rotation shaft is rotated by the motor 148, as the permanent magnets 148*m* of N poles and S poles are mounted on the outer peripheral surface of the rotating shaft, the magnetic coupling 124 of the substrate carrier 120C is rotationally driven, and the rotational driving force is transmitted to the polishing head 120 connected to the connection portion 120*z*.

At the same time, when the pneumatic connector 142 of the docking device 140 is inserted into the pneumatic port 123*x* of the substrate carrier 120C, pneumatic pressure is supplied from the docking device 140 to the substrate carrier 120C. The monitoring unit 200 is provided with a pneumatic sensor (not shown) for measuring the pneumatic pressure supplied to the inside of the substrate carrier 120C so as to monitor whether pneumatic pressure is normally supplied from the pneumatic connector 142 to the substrate carrier 120C. The monitoring unit 200 transmits the measurement value of the pneumatic sensor to the control unit 300, the memory 400 and the display unit 500 as a monitoring signal S1.

Although not shown in the drawing, in the docked state between the docking device 140 and the substrate carrier 120C, a power supply line for supplying power to the pneumatic sensor and a signal line for transferring the pneumatic measurement value to the outside of the substrate carrier 120C are also provided with being connected with the docking device 140. Thus the measured value of the pneumatic sensor can be transmitted to the outside of the substrate carrier 120C as the monitoring signal S1.

That is, the states and the operations in which the docking device 140 is docked to the substrate carrier 120C are monitored by the monitoring unit 200. The monitoring unit 200 transmits the monitoring signal S1 to the control unit 300, and the control unit 300 senses or detects in real time whether the substrate carrier 120C is working normally. The monitoring signal S1 is also transmitted from the monitoring unit 200 to the memory 400, and the memory stores the monitoring signal S1. The monitoring signal S1 is also transmitted from the monitoring unit 200 to the display unit 500, and the states and operations are displayed so that operator can check in real time the status of the operation of the substrate carrier 120C from the displayed screen (S140).

As described above, when pneumatic pressure and rotational driving force (not shown in the figure, but may be supplied with power) are supplied to the substrate carrier 120C by the docking device 140, the polishing head 120 connected with the substrate carrier 120C via the connecting part 120*z* is in a state in which the substrate W can be pressed downward and rotated 120*r*.

Figure 5:
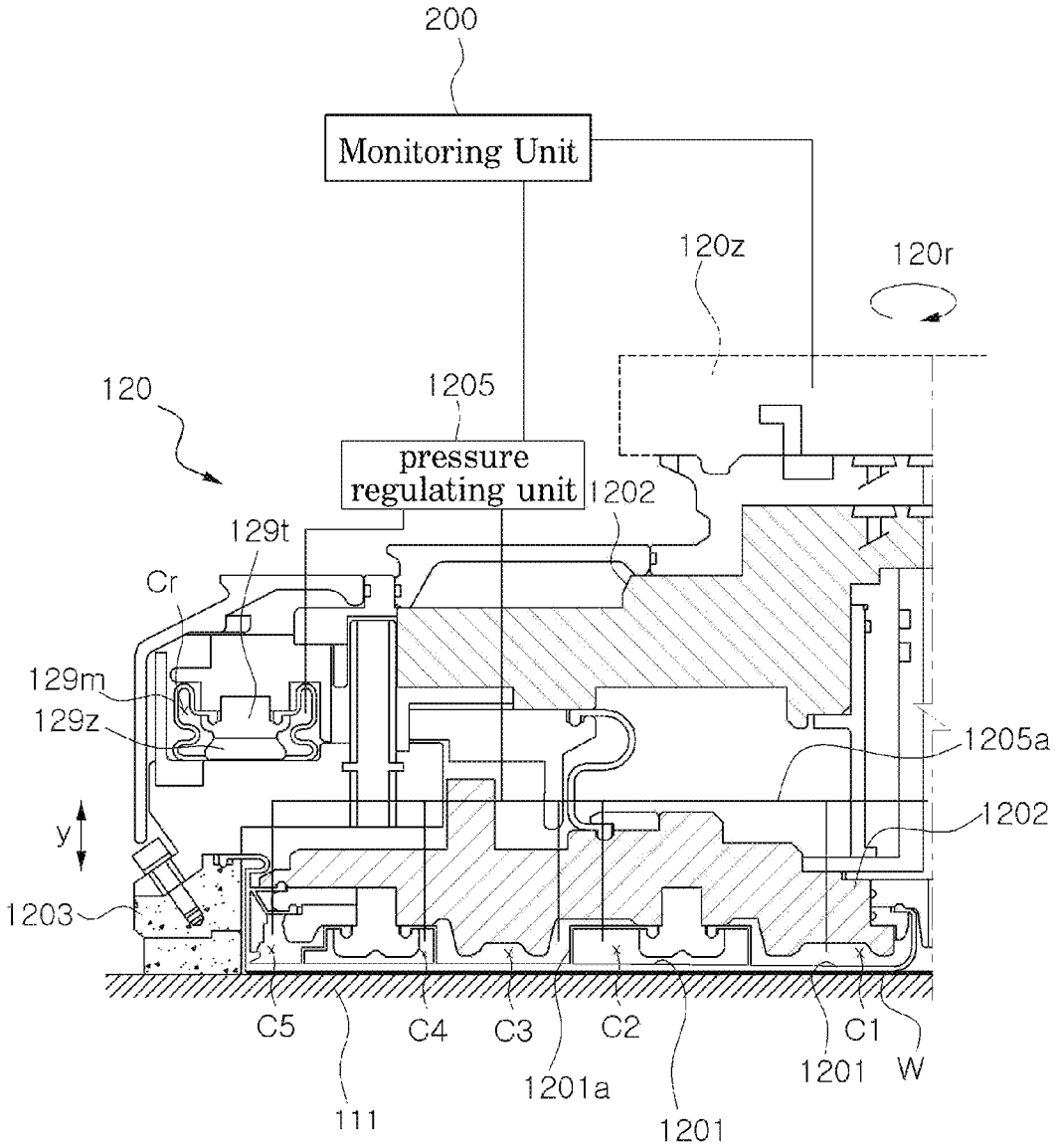
FIG. 5 is a half sectional view showing the configuration of the polishing head of FIG. 4.

As shown in FIG. 5, the polishing head 120 includes a membrane 1201 formed of a flexible material such as polyurethane to be maintained to contact with the substrate W and a base 1202 for fixing the flap 1201*a* of the membrane 1201.

A plurality of pressure chambers C1, C2, C3, C4, C5: C are formed between the bottom portion of the membrane 1201 and the base 1202. Each of the pressure chambers C1, C2, C3, C4, C5 are independently supplied with pneumatic pressure from the rotary union 123 through the pneumatic supply pipe 1205*a* under the control of the pressure regulating unit 1205, so that the substrate W positioned below the membrane bottom portion is pressed by the pressure of the pressure chambers C1, C2, C3, C4, C5 with the contact with the polishing pad 111. Thus the polishing layer of the substrate W is polished by the independently controlled pressure of the pressure chambers.

On the other hand, according to one embodiment of the present invention, the polishing head 120 is provided with a retainer ring 1203 surrounding the periphery of the substrate W, and a retainer chamber Cr formed in a ring shape in the form of a retainer ring 1203 pushes down or pulls the retainer ring 1203 downwards or upwards. The retainer chamber Cr includes two ring-shaped members 129*z*, 129*t* which are surrounded by the flexible ring-shaped membrane 129*m* capable of expanding or contracting. Accordingly, when positive pressure is supplied from the pressure regulator unit 1205, the ring-like members 129*z*, 129*t* moves to apart from each other and thus the ring-shaped membrane 129*m* expands, thereby increasing the volume of the retainer chamber Cr. On the other hand, when the negative pressure is supplied from the pressure regulating unit 1205, the ring-shaped members 129*z*, 129*t* moves to close each other, and thus the ring-shaped membrane 129*m* contracts, thereby recuding the volume of the retainer chamber Cr. That is, the retainer ring 1203 moves downwards when the volume of the retainer chamber Cr increases, whereas the retainer ring 1203 moves upwards when the volume of the retainer chamber Cr decreases.

Figure 4:
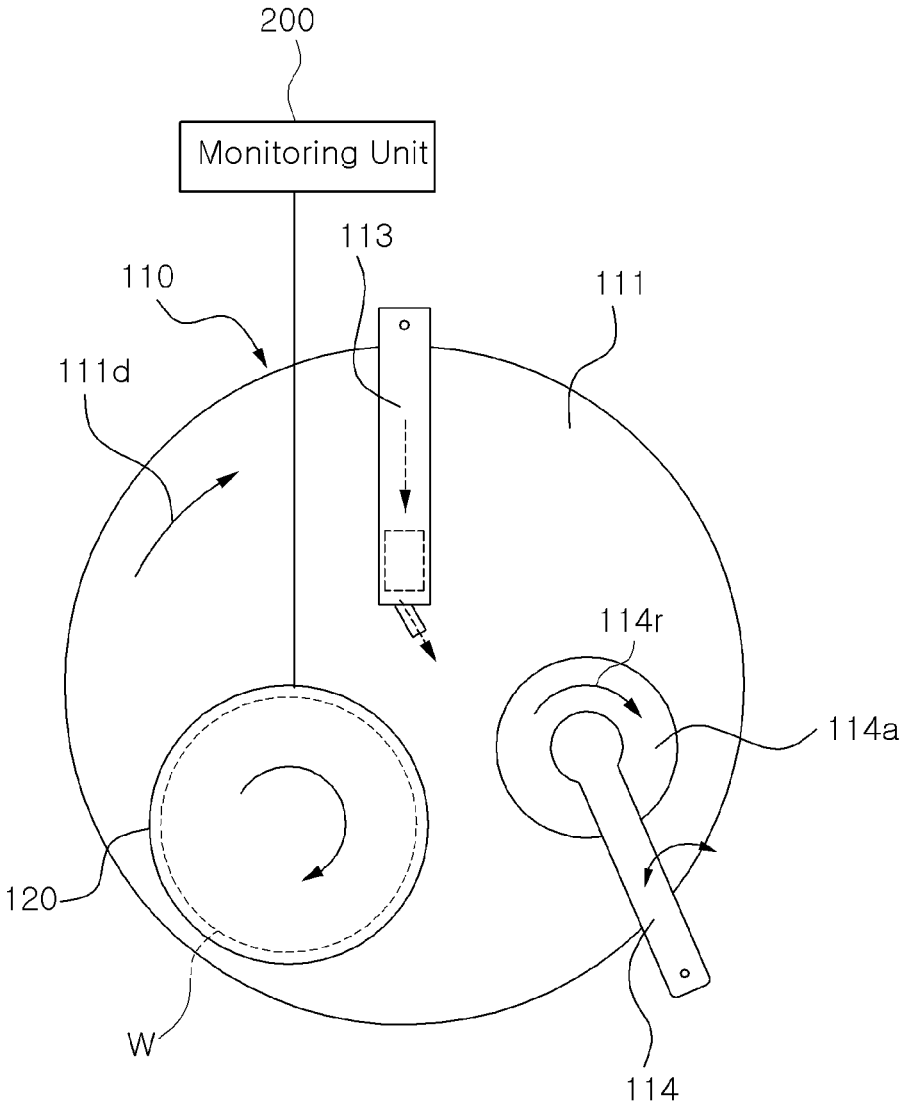
FIG. 4 is a plan view showing a configuration in which a polishing process is performed in one polishing table of FIG. 3.

As shown in FIG. 4 and FIG. 6, the substrate W is positioned below the polishing head 120 so that the polishing head 120 rotates together with the substrate W in the rotation direction 120*r* and at the same time the pressure chambers C1, C2, C3, C4, C5 press the substrate W downwards to the polishing pad 111 whereby the polishing process is performed for the substrate W. At this time, the monitoring unit 200 measures the rotation speed of the polishing pad 111 and the polishing head 120 in real time, and outputs the measured as a monitoring signal S1 is transmitted to the control unit 300, the memory 400 and display unit 500. For example, the monitoring unit 200 may include a sensor for measuring the rotation speed or may extract data as a monitoring signal S1 for the rotation speeds from encoder installed at the polishing table 110 and the polishing head 120.

The polishing process of the substrate W may be performed by supplying the slurry on the polishing pad 111 so that the chemical polishing is performed together with the mechanical polishing. In this case, as shown in FIG. 3, during the process of supplying the slurry onto the polishing pad 111 through the slurry supply unit 113, the monitoring unit 200 may monitor the slurry supply amount per unit time using a flow rate sensor (not shown), and transmits the measured data as the monitoring signal S1 of the slurry supply amount to the control unit 300, the memory 400, and the display unit 500.

On the other hand, in order to reduce the polishing time and improve the polishing quality, the slurry may be supplied to the polishing pad 111 with the controlled temperature better for the chemical polishing. At this time, the monitoring unit 200 may acquire the measured value obtained by measuring the temperature of the slurry which is being supplied to the polishing pad 111 by the slurry supply unit 113, and then may transmit the measured temperature as a monitoring signal S1 to the control unit 300, the memory 400 and the display unit 500. By monitoring the supply temperature of the slurry in real time to be supplied to the polishing pad, the polishing process is performed under temperature conditions suitable for chemical polishing of the substrate, and polishing quality can be obtained even for a shorter polishing time.

In addition, the monitoring unit 200 may transmit the temperature data which measured the temperature of the polishing pad 111 to the control unit 300 as the monitoring signal S1. This is for maintaining the temperature of the polishing pad 111 at an optimal level for the polishing condition when heat wires and/or cooling pipes for adjusting the temperature of the polishing pad 111 are provided. The temperature data of the polishing pad 111 can be transmitted to the control unit 300 in real time to monitor the temperature condition of the polishing pad 111 and to determine whether an error has occurred for the temperature adjusting means such as hot wires and cooling pipes.

A conditioner 114 for dressing the surface of the polishing pad 111 may be provided while the polishing process of the substrate W is being performed. The conditioner 114 rotates in the direction of 114*r* while the conditioning disk 114*a* with diamond particles presses downwards. The conditioning disk 114*a* sweeps for a predetermined angle about the center of rotation of the arm. Here, the monitoring unit 200 measures the pressing force of the conditioning disk 114*a* to the polishing pad 111, the rotating speed of the conditioning disk 114*a* and sweep angle of the conditioning disk 114*a*, and then transmits the measured values as a monitoring signal S1 to the control unit 300, the memory 400 and the display unit 500.

When the polishing is finished so that the thickness of the polishing layer of the substrate W becomes a predetermined value, the supply of the slurry is ended in the slurry supplying unit 113 and the rotation of the polishing platen 110 is also ended. Then the substrate W placed on the lower side of the polishing head 120 is separated from the polishing pad 111 by the polishing table 104 moving downwards or the substrate carrier 120C moving upwards.

At this time, the monitoring unit 200 transmits the monitoring signal S1 to the control unit 300, the memory 400 and the display unit 500 as to whether the substrate W is held in close contact with the bottom surface (i.e., the bottom surface of the membrane bottom portion). Here, the monitoring signal S1 may include an image of photographing the upper surface of the polishing pad 111 using a camera or an image photographing the bottom surface of the polishing head 120. Also, the monitoring signal S1 may include a signal which displacement sensor receives the displacement of the membrane bottom portion or which an eddy current sensor receives from the substrate W in case that the polishing layer of the substrate W is a metal. When the monitoring signal S1 for monitoring the state of the substrate W being in close contact with the bottom surface of the polishing head 120 is a photographed image, the control unit 300 determines whether the substrate W is located and contacted at the bottom surface of the polishing head 120. If the substrate W is not in contact with the bottom surface of the polishing head 120, the polishing process is stopped by the control unit 300 and a warning signal is output simultaneously (S150).

When the substrate W is determined to be separated from the polishing pad 111 and to be located at the polishing head 120 by the control unit 300, the substrate carrier 120C moves along the guide rails 132R . . . to the next polishing process or to the unloading device 170.

As shown in FIG. 3, when all the polishing process for the substrate is finished, the substrate W is separated from the substrate carrier 120C by the unloading device 170 while the substrate carrier 120C is positioned on the carrier shuttle 135. The unloading device 170 may be configured as disclosed in Korean Patent Registration Nos. 10-1816694 and 10-1814361 filed by the present applicant and the contents described in the Korean Patent Nos. 10-1816694, 10-1814361 are incorporated herein by reference.

In some cases, the unloaded substrate W by the unloading device 170 may be pre-cleaned in the polishing unit 100 before being transferred to the next cleaning process. And then, the substrate W is transferred to a cleaning unit (not shown) by a transfer arm (not shown) (S170).

As above, in the operation of the polishing unit 100, the monitoring unit 200 monitors the position, the state, and the operation of the polishing unit 100 (S130). In particular, the monitoring unit 200 tracks each of substrate carriers 120C via the identifier 120*x*, and monitors the position, state, and operation of each substrate carrier 120C.

The monitoring signal S1 from the monitoring unit 200 is transmitted to the control unit 300 so that the control unit 300 determines in real time whether each substrate carrier 120C moves along the predetermined position and path, and whether the substrate W mounted on the polishing head 120 is being performed under normal polishing conditions.

Simultaneously, the monitoring signal S1 acquired by the monitoring unit 200 is transmitted to the memory 400 and stored. Thus, even after the polishing process is finished, if it is necessary to precisely check why or how or if an error occurs, the monitoring signal data S1' may be transmitted to the control unit 300 whereby the error can be accurately investigated after finishing the polishing process.

To this end, the monitoring unit 200 may be formed of various sensors including a sensor 210 that senses the identifier 120*x* or cameras or the like, and the monitoring unit 200 may sense in real time the operation process including the positions and operation states of the substrate carriers 120C, and the control unit 300 detects in real time if there is an abnormality based on the monitoring signal such as sensor signals.

The control unit 300 tracks the position and movement path of each substrate carrier 120C from the monitoring signal S1 received from the monitoring unit 200. Also, the control unit 300 determines in real time if an error occurs in the position and movement path of the substrate carrier 120C.

The memory 400 stores reference data in a state where the respective operating devices including the substrate carrier 120C in the polishing unit 100 are normally operating. The control unit 300 compares the received monitoring signal S1 with the reference data which is stored the allowable range of the operating devices in advance in the memory 400, and detects or determines an error of the operating devices of the polishing unit based on the monitoring signal S1.

For example, it is monitored by the position sensors 220*i*, 220*e* that the particular substrate carrier 120C (e.g., the second substrate carrier WC2) identified by the identifier 120*x* may be accurately located at a predetermined first position X1 on the polishing platen 110 where the polishing process is to be performed. That is, as shown in FIG. 6, the carrier sensing part 210 identifying the substrate carrier 120C and the position sensors 200*i*, 200*e* of the monitoring unit 200 that sense the position of the substrate carrier 120C sense which and whether substrate carrier 120C is positioned at the first position X1 on the polishing pad 111 in real time, and this is displayed by the display unit 500 based on the received sensing data as a monitoring signal S1 so that the operator can easily and promptly notice the operation status with the substrate carrier 120C. At the same time, the position and movement path data for each substrate carrier 120C are stored in the memory 400 so that the operator quantitatively check the amount of movement error for each substrate carrier 120C even after the polishing process is completed. Then the operator corrects the current control signal applied to the coil 90 from the control unit 300 so that accurate position control can be performed for each substrate carrier 120C next time.

On the other hand, in case that the rotating speed of the polishing pad is scheduled at a speed of 'a' to 'b' rpm during the polishing process, the allowable range of the rotating speed of the polishing pad is stored in the memory 400 in advance as reference data. Thus, when the monitoring signal S1 regarding the rotation speed of the polishing pad is out of the range of the reference data, the control unit 300 can determine that there is an error in the rotation speed of the polishing pad. Here, the error information stored in the memory 400 may include the information in a range other than the reference data.

In addition, during the polishing process of the substrate, the monitoring unit 200 monitors the temperature of the slurry supplied, the amount of the slurry supplied, the temperature of the polishing pad, the rotation speed of the polishing platen, the sweep movement path and the amount of pressurization of the conditioner, a pressing amount of pressing the substrate by the polishing head, a rotating speed of the polishing head 120, and the like are monitored in real time. The control unit 300 determines in real time whether an error occurs in the operating devices by comparing the monitoring signal S1 from the monitoring unit 200 with the reference data stored in the memory 400. The display unit 500 displays at least one of the information from the monitored signal S1 obtained in the polishing process and error information of the operating devices occurred in the polishing process. The memory 400 stores the monitoring signal S1 and the error data.

As above, the control unit 300 receives the monitoring signal S1 obtained in real time in each operating device of the polishing unit 100 and determines whether any error occurs in any of operating devices in real time. When the error of the operating devices can be immediately recovered, the control unit 300 transmits the processing signal S2 to each operating devices of the polishing unit 100 in real time, and the operating condition of the operating devices is changed in real time thereby solving the error immediately.

For example, when the slurry supply amount per unit time supplied to the polishing pad 111 from the slurry supply unit 113 is out of the range defined by the reference data, a processing signal S2 (for example, a signal for adjusting the opening degree of the valve for determining the supply flow rate of the slurry supply unit 113) to the slurry supply unit 113 in real time to change the operating state in real time, thereby immediately eliminating the error of the operating device, i.e., the slurry supply unit.

Similarly, as shown in FIG. 6, when the control unit 300 determines from the monitoring signal S1 that the position of the substrate carrier 120C is out of the first position X1, the position of the substrate carrier 120C can be compensated by transmitting the processing signal S2 to coils 90 for inducing compensating current so that the substrate carrier 120C is additionally moved to a position within the allowable range of the first position X1 whereby the position error of the substrate carrier 120C can be solved.

However, when the substrate is determined to be separated from the polishing head, or when the substrate is determined to remain on the polishing pad by detaching from the polishing head after finishing the polishing process for the polishing pad, the error of the operating devices can not be solved by the modified processing signal S2 of the control unit 300. In this case, it is necessary to stop the operation of related operating devices of the polishing unit for the operator to intervene.

On the other hand, the reference data for determining whether an error has occurred in the operating devices is stored in the memory 400, and includes a data such as position, pressure, rotational speed, moving speed, within which diverse operation devices including the substrate carrier 120C operates normally. Therefore, if the measured or sensed values of the operating devices sensed by the monitoring unit 200 correspond to the outside area of the reference data, the control unit 300 detects that an error occurs in the operating devices, and the control unit 300 performs control such as correction relating to the operating device in which the error has occurred.

Considering above, in association with the error type of the operating devices of the polishing unit, the error information stored in the memory 400 is classified into fatal error information to stop a polishing process and warning error information not enough to stop the polishing process and just to warn to an operator.

Accordingly, when an error corresponding to the fatal error information is detected by any one of the operating devices of the polishing unit 100 by the control unit 300, the fatal error information is not canceled without intervention of the operator, which has a fatal influence on the polishing quality or the polishing process of other substrates.

That is, when the substrate is not maintained to be attached to the polishing head during the substrate loading process and the substrate falls outside, or when the substrate remains in the polishing pad without being separated from the polishing pad after the substrate polishing process, these errors are classified as fatal error information in the memory 400 in advance.

Accordingly, when an error corresponding to the fatal error information is detected, the polishing unit 100 stops the progress of the operation devices in real time, a warning signal S2' is transmitted to output a warning alarm for an operator to immediately intervene to correct the polishing unit (S150). In case that an error occurs once or repeatedly in a specific substrate carrier 120C, the specific substrate carrier 120C is excluded for receiving a new substrate to be polished. For example the specific substrate carrier is extracted or escaped from the movement path of the polishing unit 100 whereby it is possible to minimize the process error due to repeated use of the substrate carrier 120C in which repeated errors have occur.

That is, there is a high possibility of recurrence for a fatal error such as a docking error between the docking device 140 and the substrate carrier 120C. Thus even if a single error occurs, it is necessary to exclude the substrate carrier on which the error occurred in the docking process. With regard to errors such as a rotational speed or a pressing force of the polishing head 120, if the error is repeated two or more times, the substrate carrier is excluded from the polishing process.

In this manner, in accordance with the classification of the errors for a substrate carriers, the substrate carrier may be excluded in the event of only one fatal error because it is necessary for an operator to check and maintain immediately whereas the substrate carrier may be excluded in the event of more than two nonfatal errors.

To this end, the memory 400 classifies and stores the error information in accordance with the type of errors in the substrate carrier 120C (including the polishing head 120). That is, the error information is classified into a 'fatal error group' in which a substrate carrier should be immediately removed from the polishing process even when only one error occurs in the substrate carrier, and a 'general error group' or 'a warning error group' in which a substrate carrier may be removed from the polishing process when more than two errors occur in the substrate carrier. Therefore, if it is determined by the control unit 300 that the substrate carrier 120C is an error, it is preferable to perform different actions for the substrate carrier 120C according to the error group to which the determined error belongs.

Here, the 'general error group' may include errors in the pressing force for pressing the substrate by the polishing head during the polishing process, errors in the rotation speed of the polishing head during the polishing process, errors in position outside the allowable range at the first position X1 in which the polishing process is performed. The 'fatal error group' may include docking errors between the substrate carrier and the docking device and loading errors between the substrate carrier and the loading device, etc.

On the other hand, if the error detected by the control unit 300 corresponds to an error classified as 'warning error group' in the memory 400, the control unit 300 immediately outputs a warning alarm so that the operator can check it or automatically transmit the processing signal S2 to fix the error.

At the same time, error data of the operating devices detected as an error by the control unit 300 may be displayed on a display unit and stored in the memory 400. Here, the error data displayed on the display unit may include at least one of the error specification and operating devices detected as an error. From this, the operator can visually and clearly check the error data displayed on the display screen, easily grasp the error causes and specifications of the operating device and the operating device which an error occurs, and take proper measures considering the corresponding the error in the present polishing process or the subsequent polishing process. It is also possible to use the error data stored in the memory 400 to analyze the cause of the error after the polishing process.

On the other hand, the warning error information, which does not need to immediately stop the polishing process, is additionally classified into first warning error information capable of changing the processing signal of the operating device to fix the error in the present polishing process, and second warning error information incapable of changing the process signal of the operating device to fix the error in the present polishing process. That is, when an error corresponding to the warning error information is generated and detected in any of the operating devices, the control unit 300 performs a process of outputting a warning signal without immediately stopping the operation of the corresponding operating device and transmits the signal S2' in real time.

Concretely, when it is determined by the control unit 300 to be the first warning error that the processing signal of the operating device can correct the error during the polishing process, the control unit 300 transmits in real time the revised processing signal S2 in real time to the operating device in which an error occurs, and then immediately eliminates the error of the operating device and outputs a warning signal. In this way, the operator recognizes the error of the existing processing signal and prevents the same error from occurring in the control for the subsequent processing.

For example, the monitoring unit 200 monitors the pressures of the pressure chambers C1, C2, . . . of the polishing head 120 and the control unit 300 determines if the pressure of the pressure chambers C1, C2, . . . is within the allowable range. In case that the pressure of the pressure chambers C1, C2, . . . is out of the range based on the reference data, as the error relating to the pressure thereof corresponds to the first warning error information, the control unit send the revising processing signal S2 so that the pressure thereof of the polishing head 120 becomes within the allowable range by the pressure regulating unit 1205 based on the reference data stored in the memory 400. That is, the pressure of the pressure chamber should be changed so as to reduce the thickness difference of the polishing layer of the substrate during the polishing process. However, if the pressure difference of the neighboring pressure chambers is too high, the membrane bottom portion at the boundary of the neighboring pressure chambers is lifted. Therefore, the pressure difference between any of two neighboring pressure chambers should be maintained within the predetermined range, and thus the pressure of the pressure chambers in the polishing head is controlled within the range of the reference data. As a result, the reliability of the polishing process is improved and the planarization characteristic of the substrate polishing layer becomes more uniform.

Also, the monitoring unit 200 monitors the rotation speed of the polishing pad 111, and the control unit 300 determines if the rotational speed of the polishing pad 111 is within the allowable range. In case that the rotational speed of the polishing pad 111 is out of the range based on the reference data, as the error relating to the rotational speed thereof corresponds to the first warning error information, the control unit send the revising processing signal S2 so that the rotational speed thereof becomes within the allowable range by the driving motor based on the reference data stored in the memory 400.

Similarly, the monitoring unit 200 monitors the supply amount per unit time of the slurry supplied to the polishing pad 111, and the control unit 300 determines if the supply amount per unit time of the slurry is within the allowable range. In case that the supply amount per unit time is out of the range based on the reference data, as the error relating to the supply amount per unit time corresponds to the first warning error information, the control unit send the revising processing signal S2 to the valve to control the supply amount per unit time so that the supply amount per unit time becomes within the allowable range by the valve based on the reference data stored in the memory 400.

Also, the monitoring unit 200 monitors the rotation speed of the polishing head 120, and the control unit 300 determines if the rotational speed of the polishing head 120 is within the allowable range. In case that the rotational speed of the polishing head 120 is out of the range based on the reference data, as the error relating to the rotational speed thereof corresponds to the first warning error information, the control unit send the revising processing signal S2 so that the rotational speed of the polishing head becomes within the allowable range by the driving motor based on the reference data stored in the memory 400.

Also, the monitoring unit 200 monitors the temperature of the polishing pad 111, and the control unit 300 determines if the temperature of the polishing pad 111 is within the allowable range. In case that the temperature of the polishing head 120 is out of the range based on the reference data, as the error relating to the temperature thereof corresponds to the first warning error information, the control unit send the revising processing signal S2 to heat wires and/or cooling pipe so that the temperature of the polishing pad becomes within the allowable range by the temperature control device such as heat wires and/or cooling pipe based on the reference data stored in the memory 400.

Also, the monitoring unit 200 monitors the temperature of the slurry to being supplied to the polishing pad 111, and the control unit 300 determines if the temperature of the slurry is within the allowable range. In case that the temperature of the slurry is out of the range based on the reference data, as the error relating to the temperature thereof corresponds to the first warning error information, the control unit send the revising processing signal S2 to slurry temperature controller in the slurry supply unit 113 so that the temperature of the slurry becomes within the allowable range by the slurry temperature controller based on the reference data stored in the memory 400.

Also, the monitoring unit 200 monitors the conditioning pressure of the conditioner 114, and the control unit 300 determines if the conditioning pressure of the conditioner 114 is within the allowable range. In case that the conditioning pressure of the conditioner 114 is out of the range based on the reference data, as the error relating to the conditioning pressure thereof corresponds to the first warning error information, the control unit send the revising processing signal S2 to the conditioner so that the conditioning pressure becomes within the allowable range by the conditioner based on the reference data stored in the memory 400.

Figure 11:
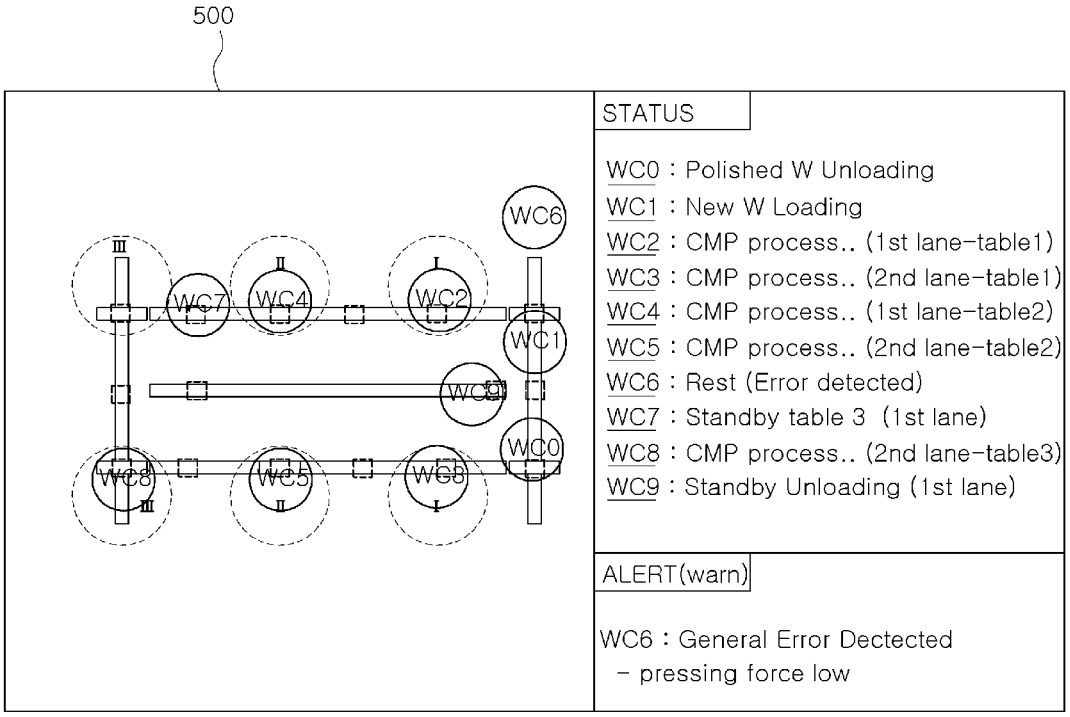
FIG. 11 is a view of a display screen that displays in real time the operating states for each substrate carrier of the substrate polishing system.

As shown in FIG. 11, the display unit 500 displays information such as a position and an operating state of the polishing unit 100 in real time for each substrate carrier 120C. Preferably, the substrate carriers WC0, WC1, . . . , 120C moving on the layout of the polishing unit 100 are schematically displayed, and the position and the operating state thereof are shown as "STATUS" item, and a warning message and the causes of the error may be displayed for the substrate carrier on which the error occurred. Although not shown in the drawings, the display unit 500 may display at least one of information about the polishing state and the like of the substrate mounted on the substrate carrier 120C and the operating state of the polishing head.

The information displayed on the display unit 500 may be displayed in real time during the polishing process and may be displayed at a delayed time relative to the time at which the polishing process by calling the data stored in the memory 400 so as to be used for the subsequent review of the polishing process For example, as shown in FIG. 11, in the display unit 500, the $0^{th}$ substrate carrier WC0 positioned in the unloading device 170 is displayed as "Polished W Unloading" whereby the substrate of the 0th substrate carrier WC0 is indicated in real time as being unloaded after the polishing process. The first substrate carrier WC1 in the loading device 160 is displayed as "New W Loading" whereby a substrate is indicated in real time as being mounted to the first substrate carrier WC1 by the loading device.

The second substrate carrier WC2 located at the first polishing platen I in the first lane is displayed as "CMP Process . . . (1st lane—table 1)" whereby the substrate in the second substrate carrier WC2 is displayed in real time as being polished mechanically and chemically at the first polishing platen I in the $1^{st}$ lane. Similarly, the third substrate carrier WC3 positioned at the first polishing platen in the second lane is displayed as "CMP Process . . . (2nd lane—table 1)" whereby the substrate in the third substrate carrier WC3 is displayed in real time as being polished mechanically and chemically at the first polishing platen I in the $2^{nd}$ lane. The fourth substrate carrier WC4 located at the second polishing platen II in the first lane is displayed as "CMP process . . . ($1^{st}$ lane—table 2)" whereby the substrate in the fourth substrate carrier WC4 is displayed in real time as being polished mechanically and chemically at the second polishing platen II in the 1st lane. Similarly, the fifth substrate carrier WC5 positioned at the second polishing platen II in the second lane is displayed in real time as "CMP process . . . ($2^{nd}$ lane—table 2)" whereby the substrate in the fifth substrate carrier WC5 is displayed in real time as being polished mechanically and chemically at the second polishing platen II in the $2^{nd}$ lane.

On the other hand, the sixth substrate carrier WC6 positioned apart from the predetermined path 120*d* is displayed as "REST" in real time whereby the $6^{th}$ substrate carrier is displayed as not being input to the polishing process. Also, in the left layout drawing in FIG. 11, the $6^{th}$ substrate carrier WC6 is displayed as being excluded from the polishing path.

That is, in case that an error occurred in the $6^{th}$ substrate carrier WC6 when the $6^{th}$ substrate carrier was input to the polishing process, as shown in the layout drawing in FIG. 11, the $6^{th}$ substrate carrier WC6 is determined to be excluded by the control unit 300 and then excluded automatically or by an operator, which is displayed on the display screen so that an operator may easily check the current status of the polishing unit 100.

Simultaneously, the display unit 500 displays the status of the $6^{th}$ substrate carrier WC6 as "General Error Dectected" and "pressing force low" whereby an operator easily notices that the error of the $6^{th}$ substrate carrier WC6 belongs to general or warning error group and its cause is the pressing force by the polishing head is lower than the allowable range of the reference data during the polishing process. That is, as exemplified in FIG. 11, the $6^{th}$ substrate carrier WC6 is detected as having an error of "pressing force low" while the polishing head introduces a low pressing force to press the substrate positioned thereunder during the polishing process, and an operator can confirm the cause of the error and exclusion from the polishing process from the warning signal displayed on the display unit 500.

On the other hand, although it is not drawn in FIG. 11, when a docking error occurs between the substrate carrier 120C and the docking device 140, since it corresponds to a 'fatal error group' stored in the memory 400, the display unit 500 displays "Fatal Error Detected—Docking error" And is displayed on the apparatus 500. Also, even if a single docking error occurs, the substrate carrier is immediately excluded from the polishing process so that the operator can immediately perform maintenance.

The $7^{th}$ substrate carrier WC7 positioned between the second polishing platen II and the third polishing platen III is displayed in real time as "Standby Table 3" whereby the $7^{th}$ substrate carrier is displayed in real time as being waiting for entering to the third polishing platen III in the first lane. Similarly the $8^{th}$ substrate carrier WC8 located at the third polishing platen III in the second lane is disapled in real time as "CMP Process . . . ($2^{nd}$ land—Table 3) whereby the substrate in the $8^{th}$ substrate carrier WC8 is displayed as being polished mechanically and chemically at the third polishing platen III in the second lane.

The $9^{th}$ substrate carrier WC9 positioned at the end of the middle lane is displayed in real time as "Standby Unloading" whereby the substrate in the $9^{th}$ substrate carrier is displayed in real time as having been polished completely and waiting for entering the unloading unit 170.

Thus, the display unit 500 displays the position and movement path (e.g., first lane or second lane), operation state, and the like for each of the substrate carriers WC1, WC2, . . . , WC9 whereby the status of the substrate carriers can be confirmed at a glance by an operator. Above all, it is possible to prevent the occurrence of repeated errors of a specific substrate carrier during the polishing process by excluding the substrate carrier in which the error occurred once or repeatedly in the polishing process automatically in accordance with the predetermined program, whereby it is possible to obtain an effect that the operator can easily recognize and efficiently maintain the substrate carrier on which an error has occurred in a short time.

On the other hand, the control unit 300 receives a plurality of monitoring signals S1 from the monitoring unit 200 in real time to determine in real time whether there is an error in various operating devices. In some cases, even if an error occurs in one operating device, it may be necessary to modify the operating states of two or more operating devices at the same time and to correct them. In addition. Or, in case that two or more errors occur in multiple operation devices at a time, it may be necessary to modify the operating states of two or more operating devices.

For this, the control unit 300 can perform the correction to change the operating state of two or more operating devices at the same time by bundling the various operating devices of the polishing unit 100 into an integrated processing signal.

For example, when an error occurs in which the pressure of the second pressure chamber C2 of the polishing head 120 exceeds the first pressure of the upper limit of the reference data in the memory 400, if the pressure of the second pressure chamber C2 is adjusted lower than the first pressure, the pressure values of the first and third pressure chamber C1, C3 neighboring the second pressure chamber 2 may be changed in accordance with the pressure value of the second pressure chamber C2.

Accordingly, in case that it is determined that the pressure value of the second pressure chamber C2 exceeds the upper limit of the allowable range stored in the reference data, the control unit 300 modifies and transmits the processing signal S2 which changes the pressure values of the first and the third pressure chambers C1, C3 in addition to the pressure vale of the second pressure chamber C2.

As a similar example, the monitoring unit 200 measures the height distribution of the polishing pad 111 from its center to the edge during the polishing process and transmits the measured height distribution to the control unit 300. Then the control unit may detect if the height distribution of the polishing pad has a value (e.g., 800 μm) which exceeds the upper limit of the allowable range in the reference data. This type of error is classified into the first warning error information because the error can be solved by the processing signal of the control unit 300.

Since the height of the polishing pad 111 is adjusted by the pressing force for pressing the substrate W and the conditioning load for pressing the conditioning disk 114*a* downwards, the control unit 300 transmits to the polishing unit 100 the processing signal S2 which simultaneously modifies the average pressing force to the substrate of the polishing head and the conditioning force by the polishing pad position thereby solving the error in the height distribution of the polishing pad 111.

Like this, in order to solve the errors detected by the diverse monitoring signals S1, for the predetermined error types, the control unit 300 may correct an error of one operating device or plural errors of plural operating devices (herein, each of the pressure chambers in the polishing head may be regarded as a different operating device with one another) by the integrated process for the plural errors and the plural operating devices. Thus it is possible to obtain an effect to efficiently fixing the operation even in which an operation of one operating device affects on other operation of other operating device.

Even when it is detected that the substrate carrier 120C has not moved accurately to the first position X1 on the polishing pad 111, it is enough for the control unit 300 to transmit the processing signal S2 and to move the position of the substrate carrier 120C to the first position X1 by applying an additional current to the coil 90.

That is, for the part of the errors detected from the plural monitoring signals S1, the control unit 300 does not need to take the integrated process but simply transmits the processes signals S1 for the part to be processed independently with one another.

As above, the present invention monitors in real time the position, moving path, and errors of the substrate carriers 120C for polishing the substrate in real time, and detects the pressure, rotation speed, etc. of the polishing head 120 of the substrate carrier 120C in real time. In addition, it is possible to monitor the state and operation of various operating devices of the polishing unit 100 in real time, and it is possible to instantaneously detect whether there is an error.

Particularly, the present invention is characterized in that, in the process of monitoring the various operating devices of the polishing unit during the polishing process of the substrate, it is possible to provide an identifier 120*x* with a plurality of substrate carriers 120C that are input to the polishing unit 100, and if an abnormality is detected for each of the carriers 120C in view of the position, state, and error status, etc. are displayed on the display unit 500 for each substrate carrier 120C, so that the operator can promptly recognize the abnormality for each substrate carrier 120C and thus it is possible to obtain an efficiency of maintenance.

In addition, the present invention stores normal and error data sensed by the monitoring unit 200 in the memory 400 for each substrate carrier 120C, thereby tracking each substrate carrier after the polishing process for finding the detailed causes of the errors. Therefore, it is possible to more easily and reliably prevent the occurrence of the similar errors in the subsequent polishing process.

Above all, the present invention excludes a failed substrate carrier from the polishing process if one or more errors occur while monitoring the position, movement path, and operating states for each substrate carrier 120C, whereby it is possible to prevent an occurrence of a process error repeatedly by the substrate carrier on which an error has occurred.

To this end, the present invention classifies errors generated in the substrate carrier 120C into a "fatal error group" and a "general or warning error group". When an error belonging to "fatal error group" is detected, the substrate carrier on which the error is detected is excluded from the polishing process even if only one error is detected. If an error belonging to the general error group is detected, a predetermined number of times (for example, two or three, etc.) is repeatedly detected, the substrate carrier is automatically excluded from the polishing process thereby maximizing the process efficiency.

The present invention is also capable of automatically detecting errors by monitoring the state and operation of a plurality of operating devices of a polishing unit in real time, and classifying the errors in the polishing process in accordance with the interference of an operator and the necessity of the stop the polishing process, etc., whereby it is possible to improve the stability and reliability of the substrate processing process by systematically coping with errors of the polishing unit.

In addition, the present invention may solve by the integrated correction process the error generated in any one of the operating devices during the polishing process, in which the error of any one of the operating devices may be solved by changing the processing states of two or more operating devices integrally and simultaneously, whereby the unpredictable error is prevented during the correction process of the error generated in one operating device.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

EXPLANATION OF NUMERALS

1: substrate polishing system
100: polishing unit

111: polishing pad
113: slurry supply unit
114: conditioner
120: polishing head
120C: substrate carrier
140: docking device
142: pneumatic connector
200: monitoring unit
300: control unit
400: memory
500: display unit

What is claimed is:

1. A substrate polishing system for performing a polishing process for a plurality of substrates including the first substrate and the second substrate, comprising:

a polishing pad covered on the polishing platen;

a plurality of substrate carriers including a first substrate carrier which moves in a state in which a substrate is mounted and performs a polishing process in a state in which the substrate is in contact with the polishing pad on the polishing pad; and a monitoring unit for monitoring the information including the identity, and position of at least one of the substrate carriers, wherein the plurality of substrate carriers respectively, independently moves along a predetermined movement path, wherein error information is classified and stored in at least one memory as two or more error groups with respect to errors that may occur in the substrate carrier, wherein a control unit excludes the substrate carrier from loading a new substrate when at least one error occurs in at least one of the position and operation of the substrate carrier.

2. The substrate polishing system of claim 1, wherein the control unit excludes the substrate carrier from loading the new substrate by escaping the substrate carrier from the movement path.

3. The substrate polishing system of claim 1, wherein:

the memory stores reference data in which operating devices in the polishing unit normally operate during the polishing process; and the control unit detects an error of the operating devices by comparing the monitoring signal by the monitoring unit with the reference data.

4. The substrate polishing system of claim 1, wherein the polishing pads are plural and the substrate is polished sequentially at plural polishing pads.

5. The substrate polishing system of claim 1, wherein the control unit outputs a warning signal when an error occurs in at least one of a position and an operation of at least one of the substrate carriers.

6. The substrate polishing system of claim 5, wherein the control unit corrects in real time the errors detected in any one of the operating devices.

7. The substrate polishing system of claim 5, wherein the control unit changes the operations of the two or more operating devices to solve one error detected in one operating device.

8. The substrate polishing system of claim 1, wherein the error group is classified into a 'fatal error group' that excludes a substrate carrier even if one error occurs, and a 'general error group' that excludes a substrate carrier after two or more errors have occurred system.

9. The substrate polishing system of claim 8, wherein the fatal error group includes a docking error between the substrate carrier and a docking device.

10. The substrate polishing system of claim 8, wherein the general error group includes at least one of an error in the pressing force for pressing the substrate by a polishing head during the polishing process, a rotational speed error in the polishing head during the polishing process, and a position error outside the predetermined allowable range from a first position when the polishing process is performed.

11. The substrate polishing system of claim 1, wherein the substrate carriers are provided with an identifier and the monitoring unit identifies the substrate carrier through the identifier.

12. The substrate polishing system of claim 11, wherein the monitoring units are arranged in plural along the movement path of the substrate carriers to sense the position of the substrate carrier.

13. The substrate polishing system of claim 12, wherein the monitoring unit senses the identifier at a first position above the polishing pad on which the polishing process is performed.

14. The substrate polishing system of claim 12, further comprising a display unit for displaying information of the substrate carriers monitored by the monitoring unit.

15. The substrate polishing system of claim 14, wherein the position information of the substrate carriers displayed on the display device is displayed in real time.

16. The substrate polishing system of claim 14, wherein the display unit displays error information of the substrate carrier when an error is detected.

17. The substrate polishing system of claim 14, wherein the display unit displays information for each of the identified substrate carriers.

18. The substrate polishing system of claim 17, wherein the information displayed on the display device includes at least one of position information of the substrate carrier, operating state of the substrate carrier, substrate information mounted on the substrate carrier, and operating state of the polishing head connected to the substrate carrier.

19. The substrate polishing system of claim 17, wherein the information displayed on the display unit includes displaying the substrate carriers on a layout of a polishing unit.

20. The substrate polishing system of claim 12, further comprising:

a memory for storing information of the substrate carriers monitored by the monitoring unit.

21. The substrate polishing system of claim 20, wherein the memory stores the monitoring data obtained by the monitoring unit for each of the substrate carriers.

* * * * *